US010220504B2

(12) United States Patent
Brinkhuis

(10) Patent No.: US 10,220,504 B2
(45) Date of Patent: Mar. 5, 2019

(54) PORTABLE DRILL READY STAND AND TOOL CADDY

(71) Applicant: Mitchell L Brinkhuis, Littleton, CO (US)

(72) Inventor: Mitchell L Brinkhuis, Littleton, CO (US)

( * ) Notice: Subject to any disclaimer, the term of this patent is extended or adjusted under 35 U.S.C. 154(b) by 0 days.

(21) Appl. No.: 15/162,607

(22) Filed: May 23, 2016

(65) Prior Publication Data

US 2016/0339581 A1 Nov. 24, 2016

Related U.S. Application Data

(60) Provisional application No. 62/165,863, filed on May 22, 2015.

(51) Int. Cl.

| | |
|---|---|
| ***B25H 3/00*** | (2006.01) |
| ***B25H 3/06*** | (2006.01) |
| ***B25H 3/04*** | (2006.01) |
| ***A47F 7/00*** | (2006.01) |

(52) U.S. Cl.

CPC ..... *B25H 3/006* (2013.01); *A47F 7/0028* (2013.01); *B25H 3/003* (2013.01); *B25H 3/04* (2013.01); *B25H 3/06* (2013.01)

(58) Field of Classification Search

CPC ..... B25H 3/003; B25H 3/006; B25H 3/04; B25H 3/06; A47F 7/0028

USPC ..... 211/69, 70.6

See application file for complete search history.

(56) References Cited

U.S. PATENT DOCUMENTS

| | | | | | |
|---|---|---|---|---|---|
| 4,155,460 | A * | 5/1979 | Ratti | B25H 3/003 | 211/70.6 |
| 4,460,085 | A * | 7/1984 | Jantzen | A45C 11/00 | 206/349 |
| 5,377,850 | A * | 1/1995 | Liaw | B43M 99/008 | 211/11 |
| 5,379,885 | A * | 1/1995 | Chen | B25H 3/06 | 206/216 |
| 5,544,744 | A * | 8/1996 | Oman | B25H 3/028 | 206/319 |
| 5,743,416 | A * | 4/1998 | Yemini | B25H 3/04 | 211/70.6 |
| 6,769,554 | B1 * | 8/2004 | Udofiah | A45D 44/06 | 211/26.2 |

(Continued)

FOREIGN PATENT DOCUMENTS

| | | | | |
|---|---|---|---|---|
| DE | 3502646 A1 * | 7/1986 | ..... | B25H 3/02 |
| DE | 9210748 U1 * | 10/1992 | ..... | B25H 3/06 |

(Continued)

*Primary Examiner* — Stanton L Krycinski

(57) ABSTRACT

A portable drill ready stand and tool caddy has a stability base, a drill ready stand, a drill docking port, hand tool docking ports, and drill bit trays. The drill ready stand extends upwards from the stability base and may include some hand tool docking ports. The drill docking port is attached to the drill ready stand and is adapted to receive and securely hold a portable drill. The drill docking port holds the drill in a ready position so that a user can grasp the drill and immediately use it. Hand tool docking ports can hold a measuring tape, carpenter's square, pliers, or screwdrivers, etc. Drill bit trays can removably mount on the stability base and can incorporate drill bit storage ports that accept a plethora of drill bits, nut drivers, spade bits, auger bits, or any other accessory that is used with a drill.

20 Claims, 3 Drawing Sheets

(56) References Cited

U.S. PATENT DOCUMENTS 6,820,755 B1 * 11/2004 Ranjit ..... A45D 19/08 206/564
6,905,020 B2 * 6/2005 Chang ..... B25H 3/025 206/349
7,456,609 B2 * 11/2008 Fuchs ..... B25H 3/006 320/114
7,717,277 B2 * 5/2010 Meinhardt ..... B25H 3/025 206/373
7,733,057 B2 * 6/2010 Fuchs ..... B25H 3/006 320/114
8,228,026 B2 * 7/2012 Johnson ..... A47B 96/02 206/370
8,770,419 B2 * 7/2014 Carlton ..... A47F 7/0028 211/69
8,851,283 B2 * 10/2014 Wu ..... B25H 3/003 206/234
2002/0104709 A1 * 8/2002 Hines ..... B25H 3/006 182/129
2006/0249412 A1 * 11/2006 Hernandez ..... B25H 3/06 206/379
2006/0260964 A1 * 11/2006 Feldmann ..... B25H 3/006 206/373
2009/0026155 A1 * 1/2009 Bernard ..... E06C 7/14 211/70.6
2011/0290914 A1 * 12/2011 Olson ..... B05B 7/0081 239/526
2013/0277243 A1 * 10/2013 Wu ..... A47G 7/06 206/216

FOREIGN PATENT DOCUMENTS

DE 102006044927 A1 * 4/2008 ..... B25H 3/006
EP 0104866 A1 * 4/1984 ..... B25H 3/06
WO WO-0066330 A1 * 11/2000 ..... B25H 3/06

* cited by examiner

PORTABLE DRILL READY STAND AND TOOL CADDY

CROSS-REFERENCE TO RELATED APPLICATIONS

This application claims the benefit of U.S. Provisional Application No. 62/165,863 entitled PORTABLE DRILL READY STAND AND TOOL CADDY and filed on May 22, 2015, which is specifically incorporated by reference herein for all that it discloses and teaches.

TECHNICAL FIELD

The present invention relates generally to the field of hand power tools and associated construction tools; and more specifically, to a portable drill ready stand and tool caddy.

BACKGROUND

Drills and drill bits have been in use for hundreds of years. However, in more recent times, the development of electrical powered hand drills has caused an explosion in the variety of types, styles, and uses of accessories that attach to drills. Additionally, with the yet more recent advent of high-capacity, light-weight, portable batteries, the scope of that growth has continued to expand. Put quite simply: gone are the days of the simple hand drill with four sizes of wood bits; instead, many portable drill owners have a hundred or more drill bits, nut drivers, screw driver bits, spade bits, twist bits, hole saws, countersink bits, auger bits, masonry bits, etc. Additionally, the number and variety of construction, carpentry, and handyman tools continues to grow and keeping all of these items organized, and within easy reach is a significant challenge.

The battery-powered, portable drill is one of the more commonly used tools, and yet, it is often not readily at hand because of its odd shape and difficulty in keeping it upright and accessible. This is especially true if a bit or other accessory is installed in the drill chuck as the resulting tool is often too end-heavy and will not sit upright on its base. Furthermore, even if a given drill is designed to sit upright, it is very easy to knock over or damage as a construction site or work area can be a chaotic place. A number of holsters or holders which are designed to be worn exist, but they require that a person constantly carry all the weight of the drill—a significant drawback that can be dangerous when the holster or drill hooks on something or otherwise gets in the way. What is needed is a portable drill ready stand and tool caddy that safely and securely holds a drill in a ready position and provides a quick and easily-accessible storage location for drill bits and all the associated accessories, tools, etc. that are commonly needed by the carpenter, handyman, construction worker or hobbyist.

BRIEF SUMMARY OF THE INVENTION

A portable drill ready stand and tool caddy has a stability base, a drill ready stand, a drill docking port, a plurality of hand tool docking ports, and a plurality of interchangeable drill bit trays. The stability base has a relatively large footprint and provides a stable base on which the remainder of the ready stand and tool caddy rests. The drill ready stand extends upwards from the stability base and may include some of the plurality of hand tool docking ports thereon. The drill docking port is attached the drill ready stand and extends downwards therefrom. The drill docking port is adapted to receive and securely hold therein the chuck or other working-end component of a portable drill. Depending on the depth of the drill docking port, the drill can even be mounted within the drill docking port without first removing any drill bit, nut driver, etc. from the drill. The drill docking port holds the drill in a ready position so that a user can simply reach over and grasp the handle of the drill and be immediately ready to use the drill. The plurality of hand tool docking ports can be at least partially located on the stability base surrounding the drill ready stand. Common hand tools such as a measuring tape, carpenter's square, pliers, screwdrivers, etc. can be mounted in individual hand tool docking ports that can be somewhat customized to fit one or more particular tools. The plurality of interchangeable drill bit trays can be removably mounted on the back portion of the stability base. The bit trays can incorporate drill bit storage ports that accept a plethora of drill bits, self-centering bits, tapered bits, plug cutters, hex drivers, nut drivers, screw driver bits, spade bits, twist bits, hole saws, countersink bits, auger bits, masonry bits, or any other accessory that is used with a drill. A user can remove one or more standard drill bit trays and install specific drill bit trays that meet the user's particular needs at that time. For example, if the user normally has a tray with all his or her wood drill bits, he or she might remove that tray and insert a tray full of metal drill bits if taking the portable drill ready stand and tool caddy to a metal working job site.

DETAILED DESCRIPTION

Figure 1:
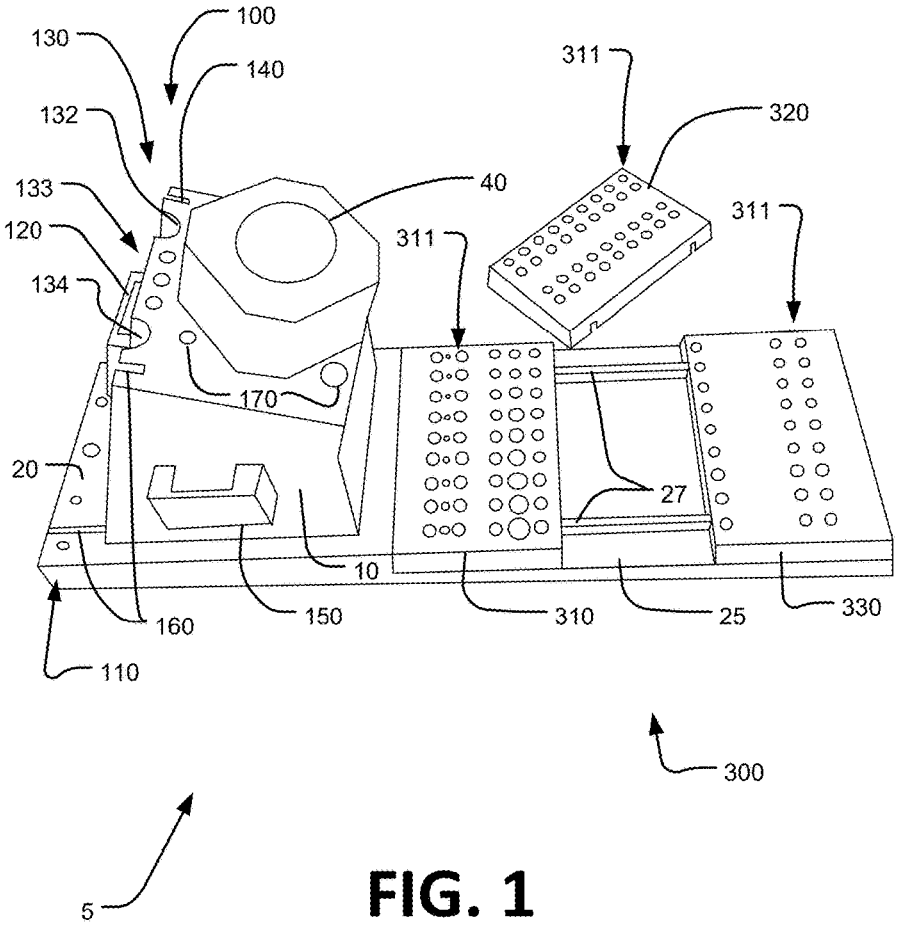
FIG. 1 illustrates a perspective top and right side view of an exemplary embodiment of a portable drill ready stand and tool caddy.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples. Similarly, in this disclosure, language such as "could, should, may, might, must, have to, can, would, need to, is, is not", etc. and all such similar language shall be considered interchangeable whenever possible such that the scope of the invention is not unduly limited. For example, a comment such as: "item X is used" can be interpreted to read "item X can be used".

Exemplary embodiments are described below and in the accompanying Figures. The following detailed description provides a review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a perspective top and right side view of an exemplary embodiment of a portable drill ready stand and tool caddy 5. In this view, a stability base 20, a drill ready stand 10, a drill docking port 40, a plurality of hand tool docking ports 100, and a plurality of interchangeable drill bit trays 300 are illustrated without the drill, drill bits, tools, etc. present. Thus, it is easy to see the various components of the caddy 5 and how they attach and/or relate to one another.

The stability base 20 has a relatively large footprint and provides a stable base on which the remainder of the ready stand and tool caddy 5 rests. In the embodiment of FIG. 1, the base 20 is shown as being approximately rectangular in shape. This allows the caddy 5 not to be overly broad or large and yet provides enhanced stability, given the weight and tipping forces of the associated drill. In other embodiments, other shapes are contemplated. In yet other embodiments, additional weights can be integrated into the base 20 to help the caddy 5 stay upright even when relatively heavy drills are placed in the docking port 40.

The stability base 20 provides stability to the drill ready stand 10 so that when the drill ready stand is holding a weighty hand drill in its drill docking port, the drill ready stand 10 can not be easily tipped over despite carrying a weight above the stability base 20. Because the weighty drill causes the center of gravity of the caddy and drill to be above the stability base 20, it is important that the base extend horizontally out from under the drill.

The drill ready stand 10 extends upwards from the stability base 20 and includes some of the plurality of hand tool docking ports 100 thereon. In the embodiment illustrated in FIG. 1, the drill ready stand 10 is shown as extending upwards at an angle of approximately seventy degrees from the approximately horizontal top surface of the base 20. In other embodiments, other angles are contemplated.

The drill docking port 40 is attached to a top portion of the drill ready stand 10 and extends downwards within the stand. The drill docking port is adapted to receive and securely hold therein the chuck or other working-end component of a portable drill 90. Depending on the depth of the drill docking port 40, the drill can even be mounted within the drill docking port 40 without first removing any drill bit, nut driver, etc. from the drill. The drill docking port 40 holds the drill in a ready position so that a user can simply reach over and grasp the handle of the drill and immediately be ready to use the drill 90. The handle and battery end of common portable drills 90 can extend over the plurality of interchangeable drill bit trays 300.

The plurality of interchangeable drill bit trays 300 are individually discernable as one of the individual bit trays 320 has been removed from the stability base rear portion 25 and placed to the side. Note the lock rails 27 that comprise a portion of the stability base 20. The lock rails 27 align the bit trays 300 and keep them in place when the caddy 5 is moved. In the embodiment illustrated in FIG. 1, the lock rails 27 extend upwards from the top surface of the rear portion 25 and fit inside rail ports on the bottom surface of the bit trays 300. In other embodiments, the rails comprise downwards trenches in the rear portion 25 and each of the bit trays 300 have downwards extending protrusions which fit inside the corresponding trenches. In either case, the lock rails 27 enmesh with the trays to secure the trays to the stability base 20. It is contemplated that other embodiments could use other means of locking the bit trays 300 to the rear portion 25. Additionally, a locking screw, bolt, hook and loop material, magnets, etc. could be used to further ensure that each tray 300 stays attached to the caddy 5 during relocation of the caddy 5 and/or use thereof.

Each of the individual bit trays 310, 320, and 330 can be made removable and can be rearranged or replaced by other bit trays. Additional bit trays 310, 320, and 330 can be configured differently to hold additional items or to hold items in different ways.

The individual bit trays 300 incorporate drill bit storage ports 311 that accept a plethora of drill bits, self-centering bits, tapered bits, plug cutters, hex drivers, nut drivers, screw driver bits, spade bits, twist bits, hole saws, countersink bits, auger bits, masonry bits, or any other accessory that is used with a drill. Other shapes, sizes, and numbers of drill bit storage ports 311 are contemplated in other embodiments.

The drill ready stand 10 extends upwards from the stability base 20 and includes some of the plurality of hand tool docking ports 100 thereon. The drill docking port 40 is attached to the top of the drill ready stand 10 and the shaft of the drill docking port 40 extends downwards within the stand. The drill docking port is adapted to receive and securely hold therein the chuck or other working-end component of a portable drill 90. Depending on the depth of the drill docking port 40, the drill can even be mounted within the drill docking port 40 without first removing any drill bit, nut driver, etc. from the drill. This feature saves the user from constantly removing and reattaching a drill bit, driver, etc. from the drill to protect it between uses. The drill docking port 40 holds the drill in a ready position so that a user can simply reach over and grasp the handle of the drill and immediately be ready to use the drill 90.

The plurality of hand tool docking ports 100 can be at least partially located on the stability base 20 surrounding the drill ready stand 10. Additionally, they can be at least partially located on the drill ready stand 10 itself. Hand tool docking ports 100 illustrated in FIG. 1 include the screwdriver docking ports 110, the tape measure docking port 120, the long shafted docking ports 130 (which include the extension shaft docking port 132, the plurality of long driver docking ports 133, and the flexible extension shaft docking port 134), the combination square docking port 140, pliers docking port 150, the square docking port 160, and the plurality of drawing utensil docking ports 170.

Figure 2:
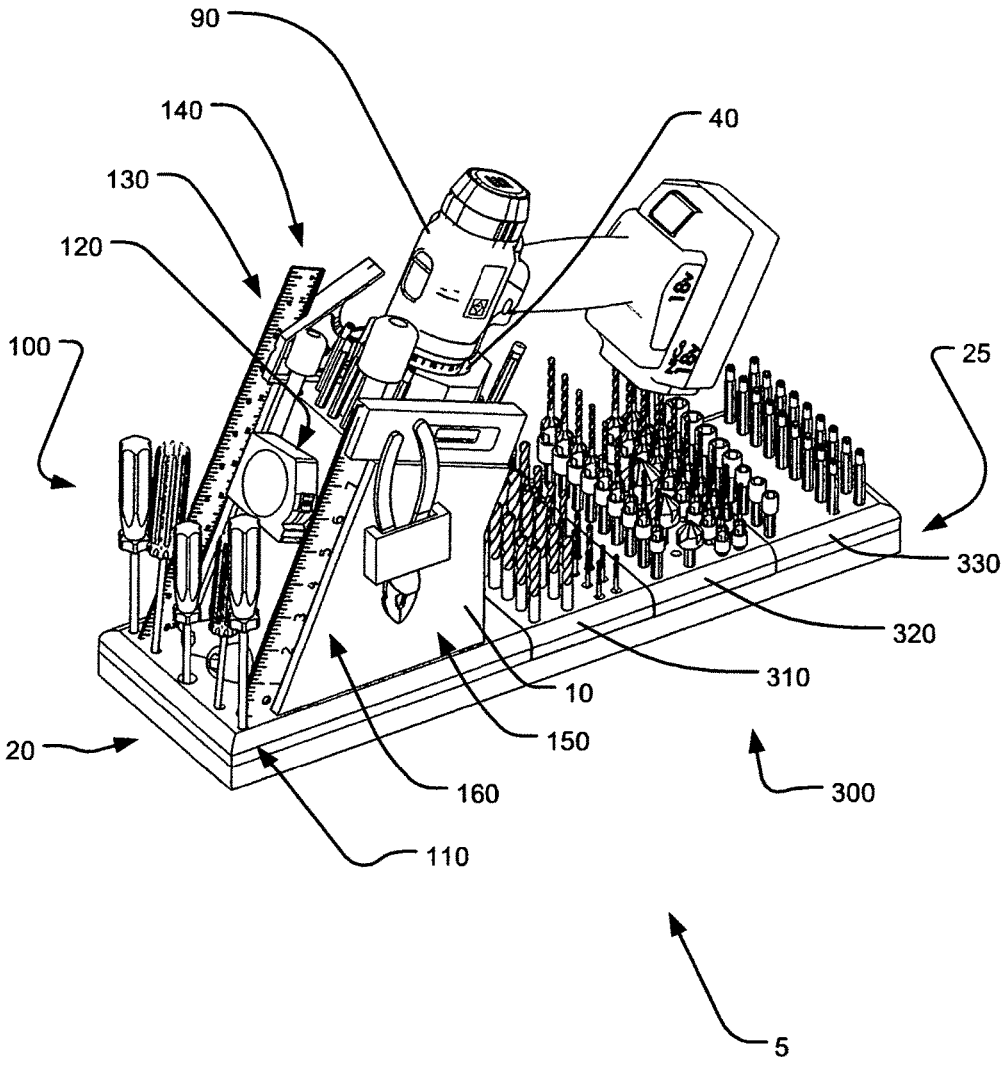
FIG. 2 illustrates a perspective front and right side view of an exemplary embodiment of a portable drill ready stand and tool caddy with drill and tools emplaced.

FIG. 2 illustrates a perspective front and right side view of an exemplary embodiment of a portable drill ready stand and tool caddy 5 with drill 90 and tools emplaced. A portable drill ready stand and tool caddy 5 has a stability base 20, a drill ready stand 10, a drill docking port 40, a plurality of hand tool docking ports 100, and a plurality of interchangeable drill bit trays 300.

The plurality of hand tool docking ports 100 can be at least partially located on the stability base 20 surrounding the drill ready stand 10. Additionally, they can be at least partially located on the drill ready stand 10 itself. Common hand tools such as a measuring tape, carpenter's square, pliers, screwdrivers, etc. can be mounted in individual hand tool docking ports that can be somewhat customized to fit one or more particular tools. This arrangement ensures that hand tools are organized and within easy reach as a user operates a drill or performs other related tasks.

The screwdriver docking ports 110 can comprise various diameter ports that are adapted to accept and hold therein the tip and/or shaft of various screwdrivers so that the screwdrivers can stand upright and be easily reachable as needed.

The tape measure docking port 120 is adapted to receive thereon a tape measure and to hold it in place and ready for use. The long shafted docking ports 130 are designed to hold long drivers, extension shafts, and flexible extension shafts. The combination square docking port 140 is adapted to hold a combination square therein. A plurality of pliers docking ports 150 (a second pliers docking port can be mirrored on the left side of the caddy, not shown in FIG. 2, but contemplated) are designed to hold pliers and needle-nose pliers. The square docking port 160 is adapted to hold a square. Additional and/or other hand tool docking ports 100 are contemplated.

The plurality of interchangeable drill bit trays 300 can be removably mounted on a rear portion 25 of the stability base 20. Individual bit trays 310, 320, and 330 can incorporate drill bit storage ports that accept a plethora of drill bits, self-centering bits, tapered bits, plug cutters, hex drivers, nut drivers, screw driver bits, spade bits, twist bits, hole saws, countersink bits, auger bits, masonry bits, or any other accessory that is used with a drill 90. A user can remove one or more drill bit trays 310, 320, and 330 and install specific drill bit trays that meet the user's particular needs at that time. Although the number of trays show in FIGS. 1, 2 and 3C is three, there can be zero, one, two, three, four or more trays in alternate embodiments.

In yet other embodiments, the type/kind/size of tools held by the caddy may very from those illustrated. For example, a plurality of extra chuck docking ports for additional drill chucks, chuck keys, hand saw, hammer, and/or other tools are contemplated.

A reduced size caddy is also contemplated in another embodiment. Such a reduced size caddy can have many of the same functions and features of the standard size caddy 5, but reduces the number and variety of the plurality of hand tool docking ports 100 and/or the number/variety of the plurality of interchangeable drill bit trays 300.

Figure 3A:
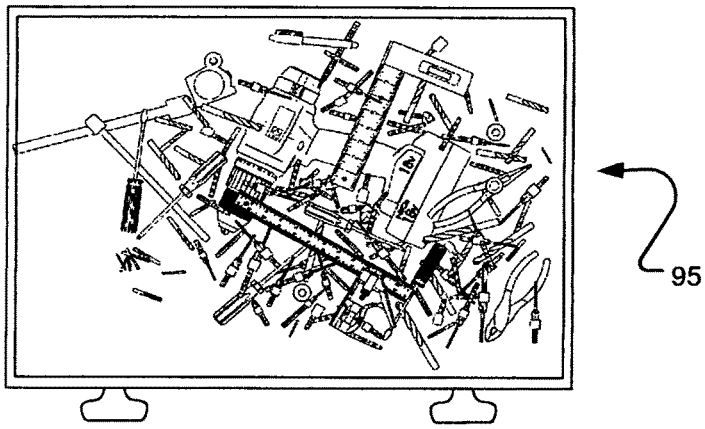
FIG. 3A illustrates a top perspective view of an exemplary embodiment of a plurality of tools in a common, unorganized workshop tool drawer.

FIG. 3A illustrates a top perspective view of an exemplary embodiment of a plurality of tools 95 in a common, unorganized workshop tool drawer. Note how jumbled and unorganized the tools are—it would be difficult to quickly locate any particular tool, especially the smaller ones, in this drawer.

Figure 3B:
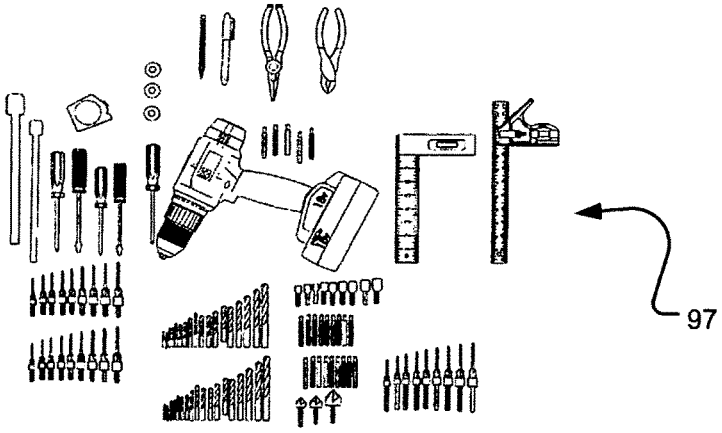
FIG. 3B illustrates a top plan view of an exemplary embodiment of the plurality of tools from the workshop tool drawer of FIG. 3A arranged for viewing.
Figure 3C:
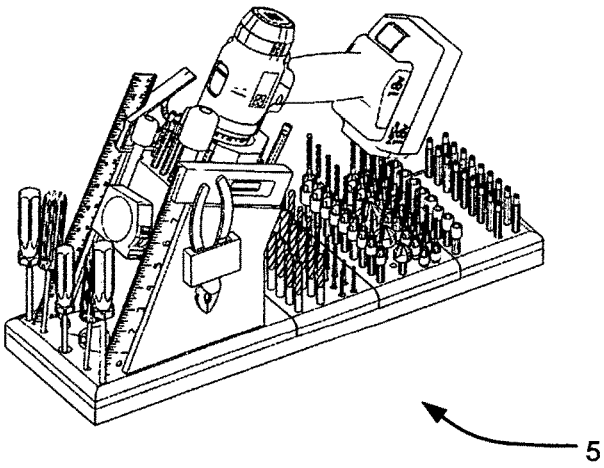
FIG. 3C illustrates a perspective top and right side view of an exemplary embodiment of the plurality of tools from FIGS. 3A and 3B arranged in place on a portable drill ready stand and tool caddy.

FIG. 3B illustrates a top plan view of an exemplary embodiment of the plurality of tools from the workshop tool drawer of FIG. 3A arranged for viewing 97. Here, the layout of the tools provides easy organization but it takes up more space and is difficult to keep organized as each time a user opens or closes the drawer, this type of arrangement would shift and relocate items.

FIG. 3C illustrates a perspective top and right side view of an exemplary embodiment of the plurality of tools from FIGS. 3A and 3B arranged in place on a portable drill ready stand and tool caddy 5. Note how all the tools are neatly arranged and organized. They are presented in an easy to use format that requires minimal space and yet they are ready for quick access and immediate use.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiments or forms disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the invention.

What is claimed is:

1. A portable drill ready stand and tool caddy, comprising:

a stability base having a proximal end and a distal end and extending horizontally therebetween;

a drill ready stand attached to the stability base near the proximal end thereof and angling upwards therefrom such that a first angle is formed between the drill ready stand and the stability base;

a drill docking port in an upper portion of the drill ready stand, the drill docking port providing a location within which a working chuck end of a portable drill is inserted and securely held so that a drill handle of the portable drill is presented in a ready position so that all portions of the drill handle and an associated actuation trigger are positioned sufficiently far away from any portion of the drill ready stand and tool caddy such that the handle and trigger are clear and can be easily and quickly grasped by a user by wrapping a user's entire hand around the drill handle and trigger and the portable drill can then be lifted up and away from the drill docking port;

the drill docking port positioned above the stability base such that the first angle is greater than forty five degrees;

the stability base providing stability to the drill ready stand so that when the drill ready stand is securely holding the portable drill in the drill docking port, the drill ready stand can not be easily tipped over despite carrying a weight of the portable drill above the stability base;

the working chuck end fitting snugly within the drill docking port such that only the working chuck end of the portable drill contacts the portable drill ready stand and tool caddy;

a plurality of hand tool docking ports configured on at least one of the stability base and the drill ready stand, the plurality of hand tool docking ports comprising a least:

a screwdriver docking port for holding a screwdriver, the screwdriver docking port comprising a receiving port within a top surface, the receiving port having sufficient cross-sectional area such that a tip of the screwdriver fits completely within the receiving port and the receiving port having sufficient depth such that when the screwdriver is placed therein, the screwdriver stands generally upright without requiring additional support;

a tape measure docking port for holding a tape measure;

a drawing utensil docking port for holding a drawing utensil; and a plurality of horizontal drill bit trays removably attaching to the top surface of the stability base, each drill bit tray comprising a plurality of drill bit storage ports that each accept and hold upright at least one of drill bits, self-centering drill bits, tapered drill bits, plug cutter drill bits, hex driver drill bits, nut driver drill bits, screw driver drill bits, spade drill bits, twist drill bits, hole saw drill bits, countersink drill bits, auger drill bits, and masonry drill bits;

the plurality of drill bit trays secured in a single plane on the stability base; and each of the plurality of drill bit storage ports comprising a generally vertical shaft deep enough to securely hold therein a shaft of a drill bit placed therein.

2. The portable drill ready stand and tool caddy of claim 1, wherein the drill docking port extends at least deep enough so that the portable drill can be placed within the drill docking port and a tool engaged within the working chuck end does not impact any portion of the caddy.

3. The portable drill ready stand and tool caddy of claim 1, wherein the stability base further comprising:

a plurality of lock rails aligning and enmeshing with the plurality of drill bit trays to secure the drill bit trays in place on the caddy while allowing them to slide in the single plane.

4. The portable drill ready stand and tool caddy of claim 2, wherein the stability base further comprising:

a plurality of lock rails aligning and enmeshing with the plurality of drill bit trays to secure the drill bit trays in place on the caddy while allowing them to slide in the single plane.

5. The portable drill ready stand and tool caddy of claim 1, wherein each of the plurality of drill bit trays is removable and interchangeable.

6. The portable drill ready stand and tool caddy of claim 2, wherein each of the plurality of drill bit trays is removable and interchangeable.

7. The portable drill ready stand and tool caddy of claim 3, wherein each of the plurality of drill bit trays is removable and interchangeable.

8. The portable drill ready stand and tool caddy of claim 4, wherein each of the plurality of drill bit trays is removable and interchangeable.

9. The portable drill ready stand and tool caddy of claim 1, wherein the plurality of hand tool docking ports further comprising:

at least a long shafted docking port which comprises at least one of an extension shaft docking port, a long driver docking port, and a flexible extension shaft docking port.

10. The portable drill ready stand and tool caddy of claim 9, wherein the plurality of hand tool docking ports further comprising:

at least one of a combination square docking port, a pliers docking port, and a square docking port.

11. The portable drill ready stand and tool caddy of claim 2, wherein the plurality of hand tool docking ports further comprising:

at least a long shafted docking port which comprises at least one of an extension shaft docking port, a long driver docking port, and a flexible extension shaft docking port.

12. The portable drill ready stand and tool caddy of claim 11, wherein the plurality of hand tool docking ports further comprising:

at least one of a combination square docking port, a pliers docking port, and a square docking port.

13. The portable drill ready stand and tool caddy of claim 4, wherein the plurality of hand tool docking ports further comprising:

at least a long shafted docking port which comprises at least one of an extension shaft docking port, a long driver docking port, and a flexible extension shaft docking port.

14. The portable drill ready stand and tool caddy of claim 13, wherein the plurality of hand tool docking ports further comprising:

at least one of a combination square docking port, a pliers docking port, and a square docking port.

15. The portable drill ready stand and tool caddy of claim 8, wherein the plurality of hand tool docking ports further comprising:

at least a long shafted docking port which comprises at least one of an extension shaft docking port, a long driver docking port, and a flexible extension shaft docking port.

16. The portable drill ready stand and tool caddy of claim 15, wherein the plurality of hand tool docking ports further comprising:

at least one of a combination square docking port, a pliers docking port, and a square docking port.

17. A portable drill ready stand and tool caddy, comprising:

a stability base having a proximal end and a distal end and extending horizontally therebetween;

a drill ready stand attached to the stability base near the proximal end thereof and angling upwards therefrom such that a first angle is formed between the drill ready stand and the stability base;

a drill docking port in an upper portion of the drill ready stand, the drill docking port providing a location within which a working chuck end of a portable drill is inserted and securely held so that a drill handle of the portable drill is presented in a ready position so that all portions of the drill handle and an associated actuation trigger are positioned sufficiently far away from any portion of the drill ready stand and tool caddy such that the handle and trigger are clear and can be easily and quickly grasped by a user by wrapping a user's entire hand around the drill handle and trigger and the portable drill can then be lifted up and away from the drill docking port;

the drill docking port positioned above the stability base such that the first angle is greater than forty five degrees;

the stability base providing stability to the drill ready stand so that when the drill ready stand is securely holding the portable drill in the drill docking port, the drill ready stand can not be easily tipped over despite carrying a weight of the portable drill above the stability base;

the working chuck end fitting snugly within the drill docking port such that only the working chuck end of the portable drill contacts the portable drill ready stand and tool caddy;

a plurality of horizontal drill bit trays removably attaching to the top surface of the stability base, each drill bit tray comprising a plurality of drill bit storage ports that each accept and hold upright at least one of drill bits, self-centering drill bits, tapered drill bits, plug cutter drill bits, hex driver drill bits, nut driver drill bits, screw driver drill bits, spade drill bits, twist drill bits, hole saw drill bits, countersink drill bits, auger drill bits, and masonry drill bits;

the plurality of drill bit trays secured in a single plane on the stability base; and a plurality of hand tool docking ports configured on at least one of the stability base and the drill ready stand, the plurality of hand tool docking ports comprising at least:

a long shafted docking port which comprises at least one of an extension shaft docking port, a long driver docking port, and a flexible extension shaft docking port; and at least one of a combination square docking port, a pliers docking port, and a square docking port.

18. The portable drill ready stand and tool caddy of claim 17, wherein the drill docking port extends at least deep enough so that the portable drill can be placed within the drill docking port and a tool engaged within the working chuck end does not impact any portion of the caddy.

19. The portable drill ready stand and tool caddy of claim 18, wherein the stability base further comprising:

a plurality of lock rails aligning and enmeshing with the plurality of drill bit trays to secure the drill bit trays in place on the caddy while allowing them to slide in the single plane.

20. The portable drill ready stand and tool caddy of claim 19, wherein each of the plurality of drill bit trays is removable and interchangeable.

* * * * *